US008025428B2

(12) United States Patent
Duguay et al.

(10) Patent No.: US 8,025,428 B2
(45) Date of Patent: Sep. 27, 2011

(54) ASSEMBLY OF LIGHT EMITTING DIODES FOR LIGHTING APPLICATIONS

(75) Inventors: Louis Duguay, Hudson (CA); Rachid Chaffai, Saint-Hubert (CA); Christian de Varennes, Ville Mont-Royal (CA)

(73) Assignee: Elumen Lighting Networks Inc., Montreal, Québec (CA)

( * ) Notice: Subject to any disclaimer, the term of this patent is extended or adjusted under 35 U.S.C. 154(b) by 0 days.

(21) Appl. No.: 11/792,546

(22) PCT Filed: Dec. 6, 2005

(86) PCT No.: PCT/CA2005/001847

§ 371 (c)(1),
(2), (4) Date: Apr. 28, 2008

(87) PCT Pub. No.: WO2006/060905

PCT Pub. Date: Jun. 15, 2006

(65) Prior Publication Data

US 2008/0212329 A1 Sep. 4, 2008

Related U.S. Application Data

(60) Provisional application No. 60/633,445, filed on Dec. 7, 2004.

(51) Int. Cl.
*F21V 3/00* (2006.01)

(52) U.S. Cl. ..... 362/311.02; 362/249.02; 362/249.07; 362/249.11

(58) Field of Classification Search ..... 362/310, 362/311.02, 249.01, 249.02, 249.07, 153.1, 362/249.11, 544, 545, 548, 646
See application file for complete search history.

(56) References Cited

U.S. PATENT DOCUMENTS

| | | | | |
|---|---|---|---|---|
| 4,654,629 | A * | 3/1987 | Bezos et al. | 246/473.3 |
| 5,580,163 | A | 12/1996 | Johnson, II | |
| 6,120,164 | A | 9/2000 | Libin et al. | |
| 6,585,395 | B2 * | 7/2003 | Luk | 362/249.02 |
| 6,626,558 | B2 * | 9/2003 | Momot et al. | 362/109 |
| 6,784,357 | B1 | 8/2004 | Wang | |
| 7,347,706 | B1 * | 3/2008 | Wu et al. | 439/320 |
| 2002/0163805 | A1 | 11/2002 | Hubbell et al. | |

(Continued)

FOREIGN PATENT DOCUMENTS

DE 199 62 837 A1 7/2001

(Continued)

OTHER PUBLICATIONS

Supplementary European Search Report dated Feb. 4, 2008 issued in Application No. EP 05 81 5997.

(Continued)

*Primary Examiner* — John A Ward
(74) *Attorney, Agent, or Firm* — Venable LLP; Robert Kinberg

(57) ABSTRACT

An assembly of light emitting diodes for a streetlight or the likes comprises a first board having a first matrix of light emitting diodes (LEDs) mounted thereon defining a first light projection plane and at least another board having a second matrix of LEDs mounted thereon defining a second light projection plane. The other boards are mounted to the first board so as to define an angle therebetween. The LEDs can be mounted to the boards so as to independently define and angle therewith. They can also be oriented towards privileged directions. The present assembly allows providing a more uniform light distribution.

7 Claims, 14 Drawing Sheets

U.S. PATENT DOCUMENTS

| | | | |
|---|---|---|---|
| 2003/0193802 | A1 | 10/2003 | Luk |
| 2004/0105264 | A1 | 6/2004 | Spero |
| 2004/0130891 | A1 | 7/2004 | Twardawski |
| 2004/0222947 | A1 | 11/2004 | Newton et al. |

FOREIGN PATENT DOCUMENTS

| | | | |
|---|---|---|---|
| DE | 202 11 438 | U1 | 11/2003 |
| EP | 1 431 653 | A2 | 6/2004 |
| EP | 1 600 688 | A1 | 11/2005 |
| WO | WO 98/33007 | A1 | 7/1998 |
| WO | WO 02/16826 | A1 | 2/2002 |

OTHER PUBLICATIONS

International Search Report and Written Opinion issued in PCT/CA2005/001847 dated Mar. 28, 2006.

* cited by examiner

ASSEMBLY OF LIGHT EMITTING DIODES FOR LIGHTING APPLICATIONS

FIELD OF THE INVENTION

The present invention relates to lighting. More specifically, the present invention is concerned with an assembly of light emitting diodes for lighting applications such as in streetlights.

BACKGROUND OF THE INVENTION

Conventional streetlights include a metal halide, mercury or sodium light bulb. Even though such conventional streetlights light usually include a reflector to project the light towards an area to illuminate, a first drawback of conventional streetlights is that they waste energy since the light bulb illuminates in all direction, even though illumination is only required towards the street. Another drawback of streetlights provided with a light bulb is that they generate a high luminosity right below the bulb which diminishes quickly as the distance from the bulb increases.

A partial solution to these drawbacks has been proposed with the introduction of streetlights 10 provided with a light emitting diode (LEDs) assembly 12. Examples of such streetlights are shown in FIG. 1 of the appended drawings.

The streetlights 10 share the second drawback of the bulb light-based streetlight in that they generate a high luminosity right below the bulb which diminishes quickly as the distance from the bulb increases. Also, with such a light assembly, a high percentage of light is still lost.

Finally, a common drawback of both bulb-based light assemblies and of current LEDs assemblies is that they cause light pollution by providing light where it is not desired.

A streetlight providing a more uniform light distribution is thus desirable.

OBJECTS OF THE INVENTION

An object of the present invention is therefore to provide a streetlight free of the above-mentioned drawbacks.

Another object of the invention is to provide an improved assembly of light emitting diodes for a light.

SUMMARY OF THE INVENTION

More specifically, in accordance with the present invention, there is provided an assembly of light emitting diodes for a light comprising:

a first board having a first matrix of light emitting diodes (LEDs) mounted thereon defining a first light projection plane;

a second board having a second matrix of LEDs mounted thereon defining a second light projection plane; the second board being mounted to the first board so as to define a first angle therebetween.

According to a second aspect of the present invention, there is provided an assembly of light emitting diodes for a light comprising:

at least one board including a plurality of light emitting diodes (LEDs) mounted thereon; a first group of the plurality of LEDs being mounted to the board so as to define a first acute angle therewith; the first group of the plurality of LEDs defining a first light projection plane.

According to a third aspect of the present invention, there is provided an assembly of light emitting diodes for a light comprising:

at least one board of light emitting diodes (LEDs) defining a light projection plane; at least some LEDs of at least one of the at least one board of LEDs defining an angle with at least one of the at least one board of LEDs.

According to a fourth aspect of the present invention, there is provided an assembly of light emitting diodes for a light comprising:

a first board including a first set of light emitting diodes (LEDs) mounted thereon;

at least one other board including a second set of LEDs mounted thereon; the at least one other board being mounted to the first board so as to define an angle therewith.

Finally, according to a fifth aspect of the present invention, there is provided an assembly of light-emitting diodes (LEDs) for a light comprising:

a plurality of slats pivotably mounted to a frame so as to define a louver assembly; each the slats including a matrix of LEDs mounted thereto; and a mechanism for pivoting each the slats relative to the frame, thereby allowing to define and modify relative angles between the slats and the frame.

Other objects, advantages and features of the present invention will become more apparent upon reading the following non restrictive description of preferred embodiments thereof, given by way of example only with reference to the accompanying drawings.

BRIEF DESCRIPTION OF THE DRAWINGS

In the appended drawings:

FIG. 9 is a cross section of an assembly of light emitting diodes for a streetlight according to a third illustrative embodiment of the present invention;

FIG. 16 is a front perspective view of an assembly of light emitting diodes for a light according to a tenth illustrative embodiment of the present invention.

DESCRIPTION OF THE PREFERRED EMBODIMENT

Figure 1:
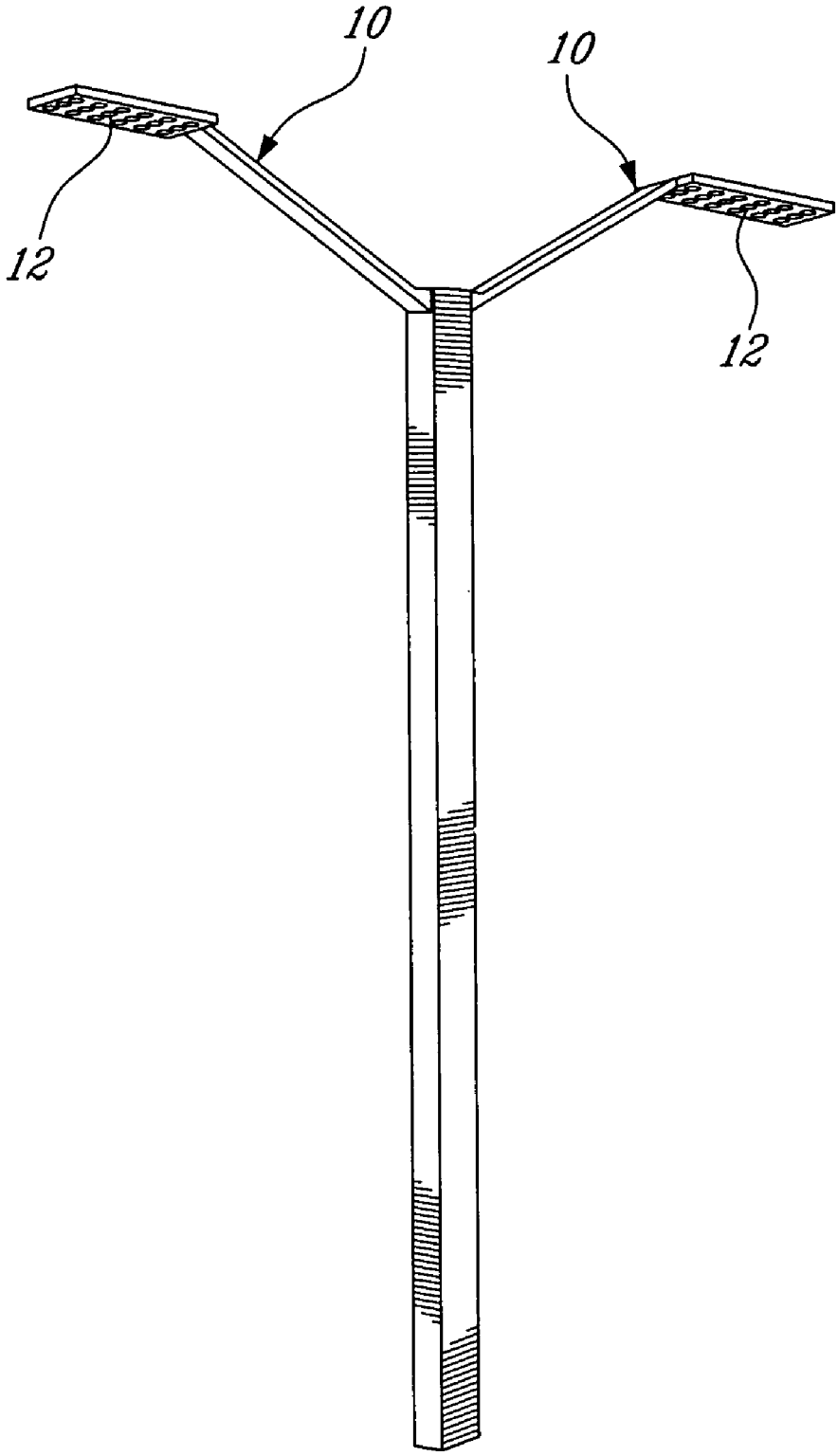
FIG. 1 (PRIOR ART)
FIG. 1, which is labeled "Prior Art" is a perspective view of a streetlight according to the prior art.
Figure 2:
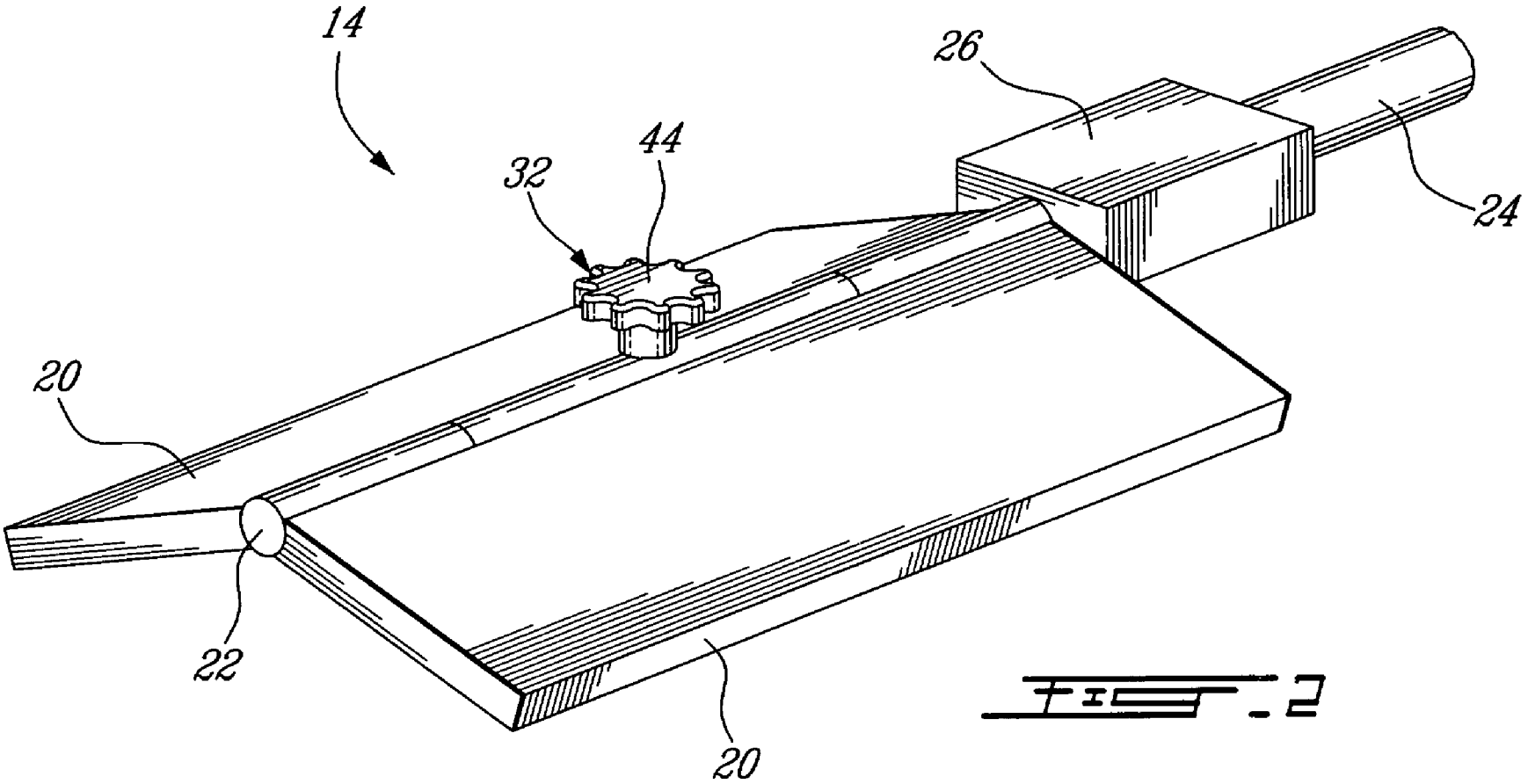
FIG. 2 is a perspective view of an assembly of light emitting diodes for a streetlight according to a first illustrative embodiment of the present invention.
Figure 3:
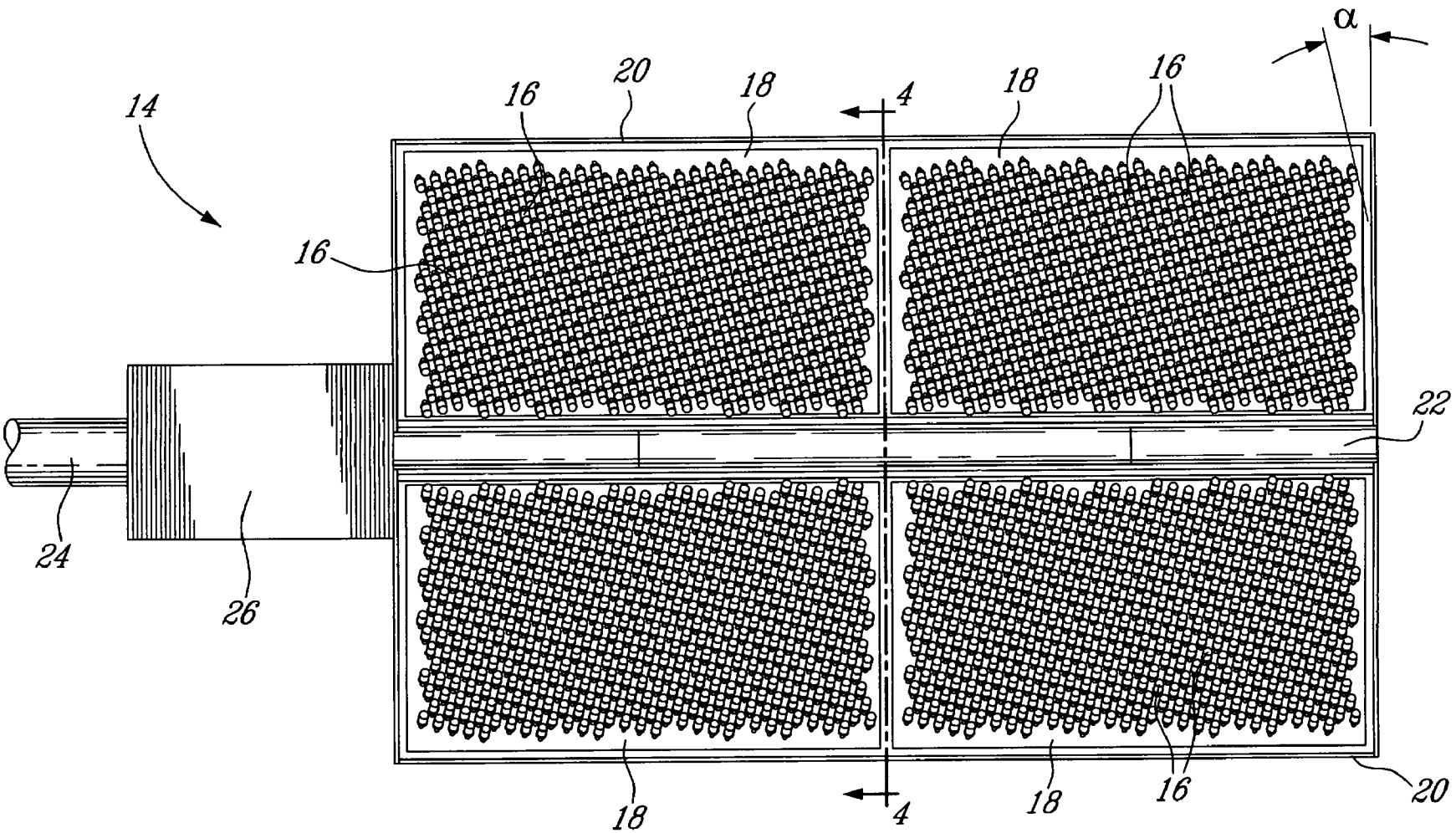
FIG. 3 is a bottom plan view of the assembly from FIG. 2.

An assembly 14 of light emitting diodes 16 for a streetlight (not shown) according to a first illustrative embodiment of the present invention will now be described with reference to FIGS. 2-4.

The assembly 14 comprises two pairs of boards 18, each including a matrix of light emitting diodes (LEDs) 16 mounted thereon, each pair of boards 18 being mounted in a respective flat casing or panel 20 defining a respective light projection plane. The two panels 20 are pivotably mounted to one another via a central shaft 22 so as to be movable between a first extended position, wherein the two panels 20 lay generally in the same plane, and a second partially closed position, wherein the two panels 20 define an angle (180°-2Φ) therebetween.

The assembly 14 is secured to the horizontal pole 24 of a streetlight pole (not shown) via its central shaft 22 so that the panels 20 are generally oriented towards the area to illuminate. A system for controlling the matrix of LEDs 16 is provided between the utility line (not shown) and the matrix of LEDs 16. As can be better seen from FIGS. 2 and 3, such controlling system 26, which includes a power converter, can be mounted at the proximate end of the shaft 22.

Figure 4:
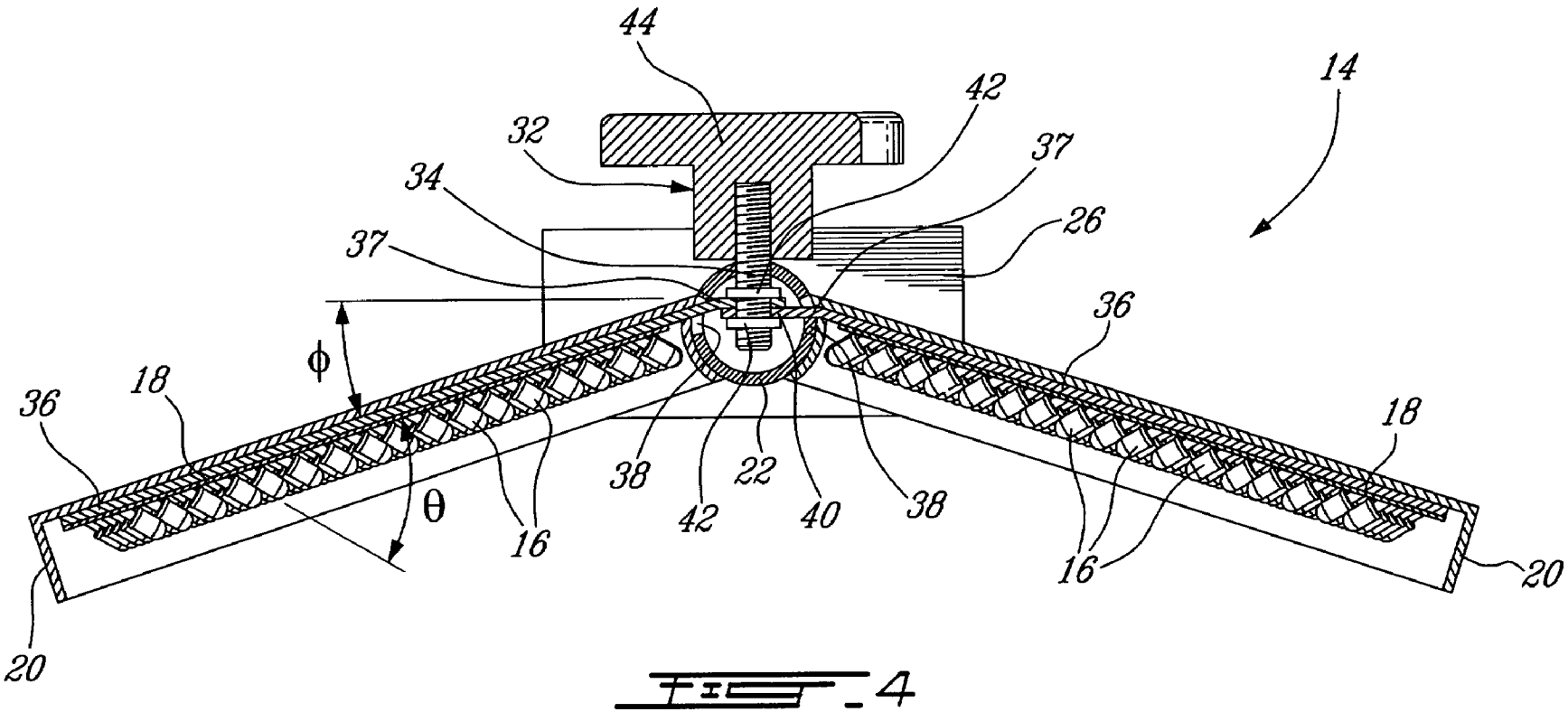
FIG. 4 is a cross-section of the assembly from FIG. 2, taken along line 4-4 on FIG. 3.
Figure 7:
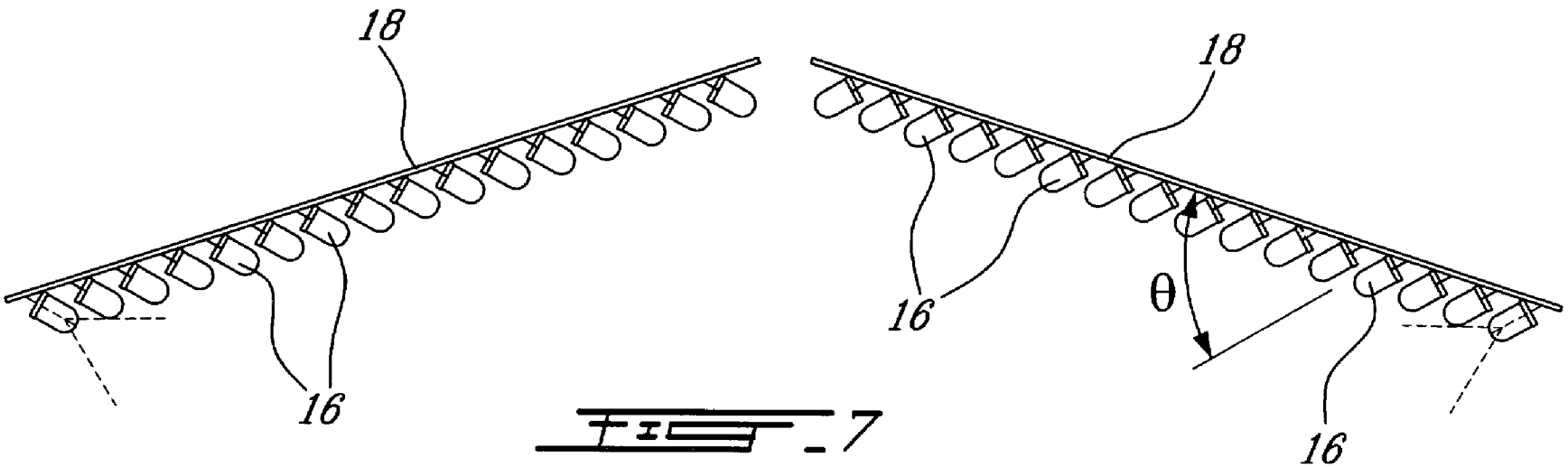
FIG. 7 is a schematic partial cross-section of two facing boards with LEDs from the assembly of FIG. 2, illustrating the angle θ between the LEDs and the boards.

As can be better seen from FIG. 4, each LED 16 is mounted to a respective board 18 so as to be tilted towards the board in the direction of the central shaft 22, defining a first angle θ with the board 18. According to the first illustrated example, this first angle θ is about 45 degrees. As illustrated in FIG. 7, the first angle θ is selected so as to yield a maximum line of sight for each LED 16, providing the maximum illumination and minimizing the lost of lumens. This maximum illumination is however achieved when the boards 18 are angled relatively to the area to illuminate as will now be explained.

Returning to FIG. 4, each panel 20 is partially closed so as to define a second angle Φ with the plane defined by the first extended position of the panels 20. It has been found that, for a given lumen per LED, a maximum luminosity can be achieved with the LEDs 16 tilted to an angle θ of about between 20 to 90 degrees and the panels 20 partially closed so as to yield a second angle Φ of about 15 to 20 degrees. The panels 20 generally define a concave light projector.

Figure 5:
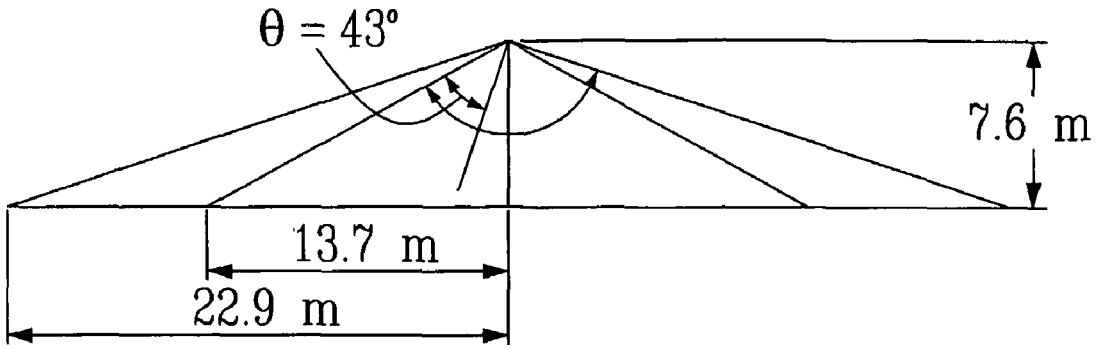
FIG. 5 is a schematic view illustrating the uniform light distribution obtained by the assembly from FIG. 2.

Indeed, as it has been mentioned hereinabove, the use of a single board having LEDs perpendicularly mounted thereon generates a high luminosity right below the bulb which however diminishes quickly as the distance from the bulb increases. As illustrated in FIG. 5, the tilting of the LEDs from about 45 degrees for example yields an illumination distance about three times the height of the pole. This illumination distance is only two times the height of the pole for a matrix of LEDs oriented parallel to the surface to illuminate.

Each tilted LED 16 is further pivoted from an angle α away from the horizontal pole 24. This pivoting of the LED 16 allows directing the light incoming from the LEDs 16 towards a more specific area to illuminate.

Figure 6A:
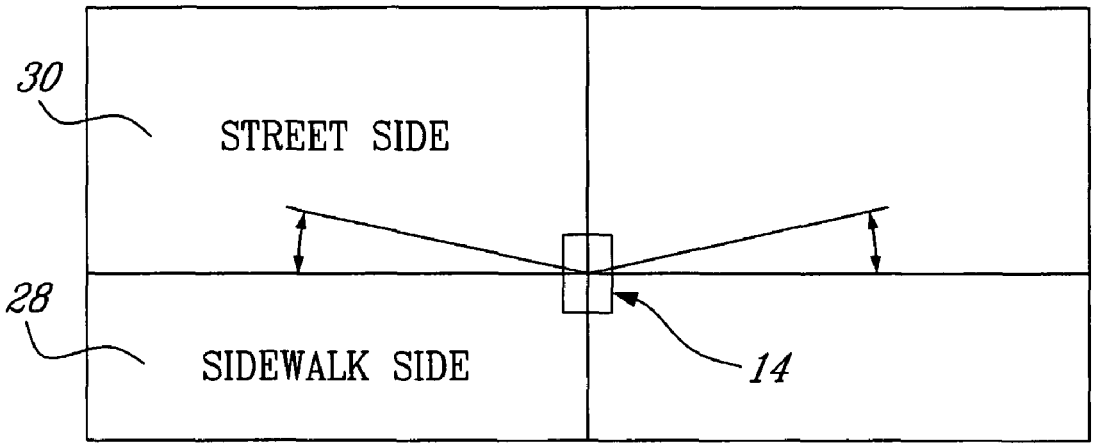
FIGS. 6A-6B are schematic views illustrating the effect of the orientation of the LEDs of the assembly from FIG. 2.
Figure 6B:
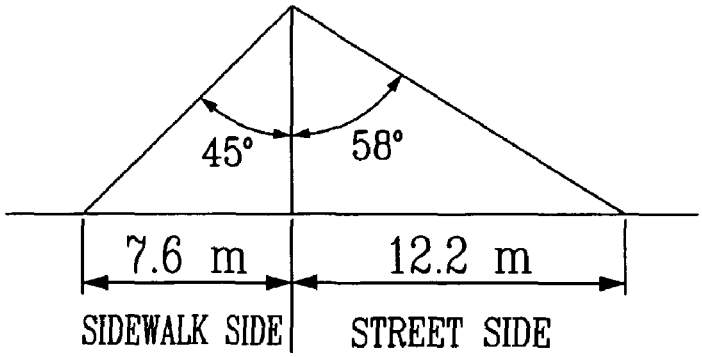

This is schematically illustrated in FIGS. 6A and 6B. FIG. 6A illustrates a top plan view of the assembly of LEDs 14 positioned on top of a sidewalk 28 and a street 30, just at the boundary thereof. FIG. 6B shows that pivoting the LEDs 16 in the direction of the street 30, yields a substantial increase of illumination on the street side 30 compare to the sidewalk side 28.

A mechanism 32 is provided to modify the angle Φ of the panels 20 including the boards 18, allowing to vary the illumination from a more intense illumination below the light assembly 10 to a more distribute illumination.

Returning to FIG. 4, the mechanism 32 comprises a screw 34 rotatably inserted in a complementary aperture on top of the hollow shaft 22 and two side plates 36 each having a respective rod portion 37 extending therefrom and received in a respective lateral slot 38 in the hollow shaft 22. The proximal ends of the rod portions 37 include an annular portion 40 for complementary engagement with the screw 34. Washers 42 are also provided for securing the annular portions 40 and therefore the two side plates 36 to the screw 34. The mechanism 32 further comprises a knob 44, secured to portion of the screw 34 extending out of the hollow shaft 22.

In operation of the mechanism 32, rotation of the knob 32 in a first direction allows to move the panels 20 towards one another, thereby increasing the angle Φ, while rotation of the knob 32 in an opposite direction allows moving the panels 20 away from each other thereby minimizing the angle Φ. It is reminded that the angle θ remains fixed during the operation of the mechanism 32.

The assembly 14 includes a typical density of 70 $mm^2$ per LED. Of course, the number of LEDs 16 per boards, of boards 18 and of panels 20 may vary without departing from the spirit and nature of the present invention. The general configuration of the assembly may also vary as will be described furtherin.

Figure 8:
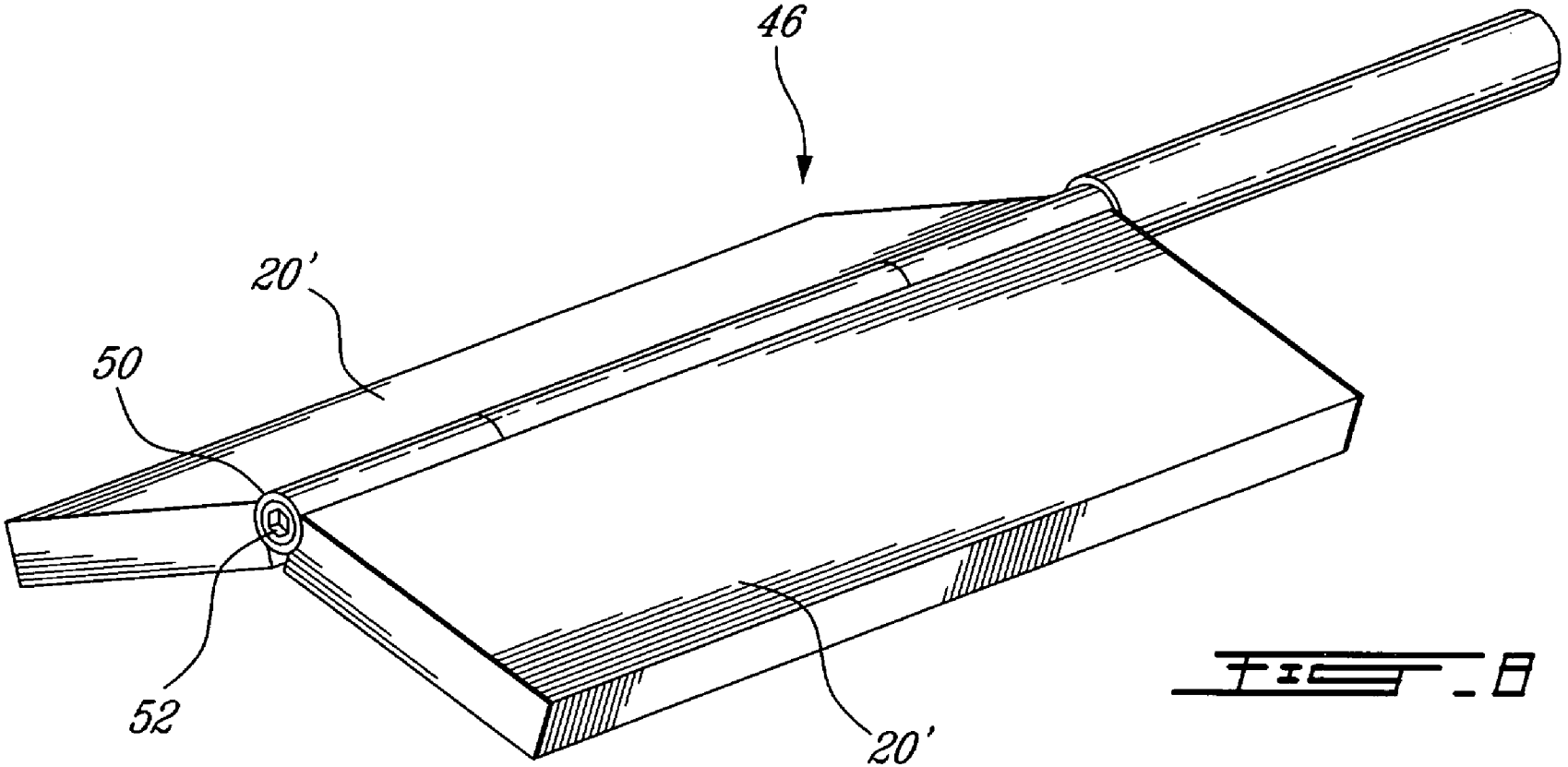
FIG. 8 is a perspective view of an assembly of light emitting diodes for a streetlight according to a second illustrative embodiment of the present invention.
Figure 5:
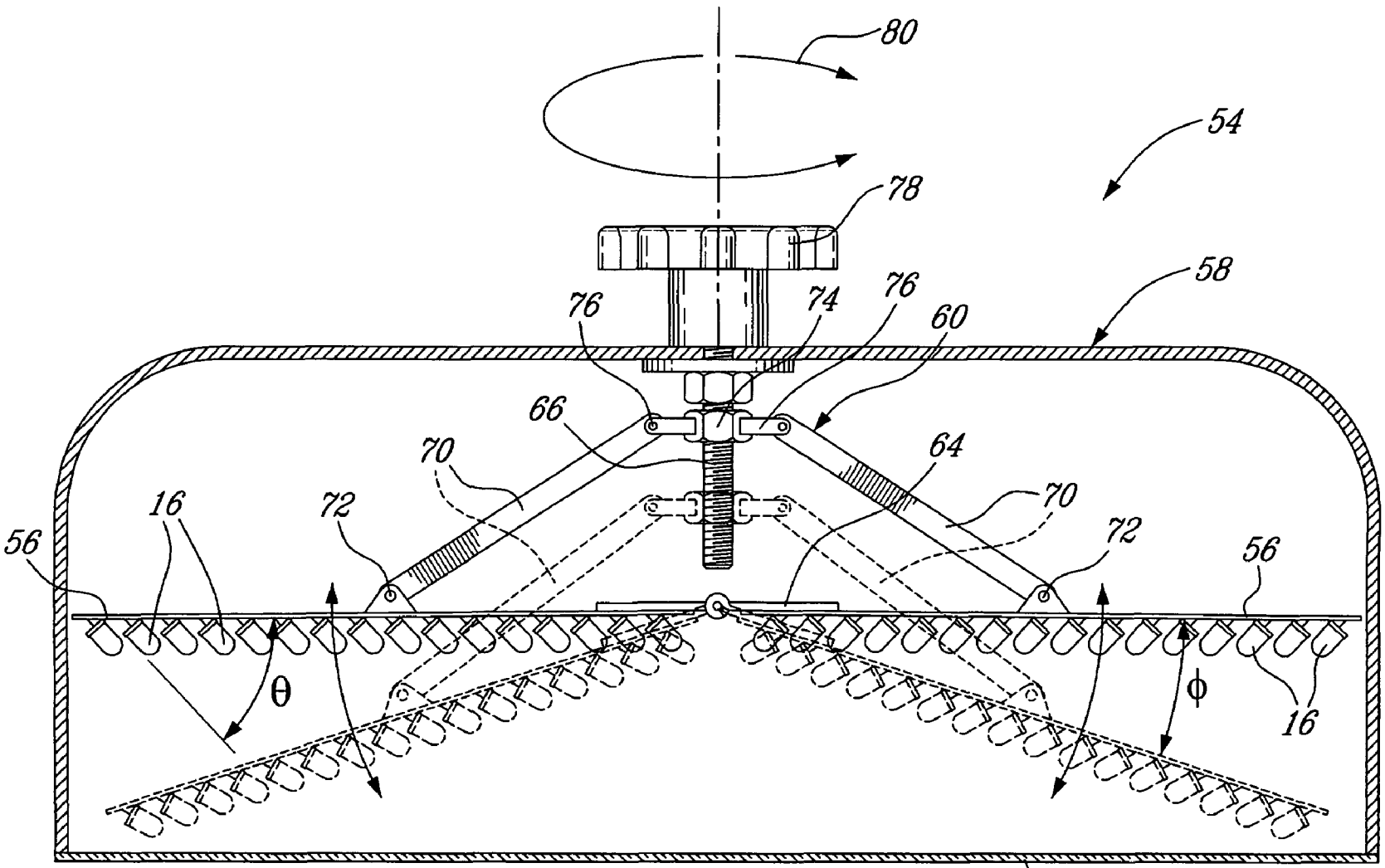

Turning now to FIG. 8, an assembly 46 of LEDs for a streetlight according to a second illustrative embodiment of the present invention will now be described. Since the assembly 46 is very similar to the assembly 14 from FIGS. 2-4, and for concision purposes, only the differences between the two assemblies will be described herein in more details.

According to this second illustrative embodiment, the controlling system (not shown) is included in the panels 20', for example between the boards (not shown) and the panels 20'.

According to this second illustrative embodiment, the panels 20' are hingedly mounted to the shaft 50 and the angle Φ of the panels 20' can be adjusted manually. A lock mechanism (not shown) operatively coupled to the panels 20' allows to lock the selected position of the panels. The lock mechanism includes an input slot 52, operable via an allen key or another tool.

An assembly 54 of LEDs 16 for a streetlight according to a third illustrated embodiment of the present invention will now be described with reference to FIG. 9.

The assembly 54 comprises two adjacent boards 56 of LEDs pivotably mounted in a casing 58 via a board mounting and adjustable mechanism 60. The open side of the casing 58 is provided with a transparent wall 62 made of glass, acrylic or polycarbonate for example.

Each LED 16 is mounted to a respective board 56 so as to be tilted towards the adjacent board 56, defining a first angle θ of about 45 degrees.

Of course, the assembly 54 further comprises a LED controlling system (not shown) for connecting the LEDs 16 to the utility line (not shown).

The two boards 56 are joined by a hinge 64.

The board mounting and adjustable mechanism 60 comprises a screw 66 rotatably secured to the top wall 68 of the casing 58 and lever arms 70 (two shown) for pivotably mounting the boards 56 to the screw 66. More specifically, the distal end of each lever arm 70 is pivotably mounted to a respective board 56 via a first pivot joint 72. The proximate end of each lever arm 70 is pivotably secured to the screw 66 via a bolt assembly 74 having second pivot joints 76 mounted on its periphery.

A knob 78 is provided at the end of the screw 66 extending from the casing 58.

In operation, rotation of the screw 66 (arrow 80) in a first direction using the knob 78 causes the downward translation of the bolt 74, which in turn causes the boards 56 to move between a first extended position (illustrated in FIG. 9), wherein the two boards 56 lay both in a horizontal plane, and a second partially closed position, wherein each of the two boards 56 defines an angle Φ with the horizontal (illustrated in dashed line in FIG. 9). Rotation of the screw 66 in the opposite direction allows diminishing the angle Φ.

Of course, the number and configuration of the boards 56 may vary. The board mounting and adjustable mechanism 60 may also be modified without departing from the spirit and nature of the present invention.

Figure 10:
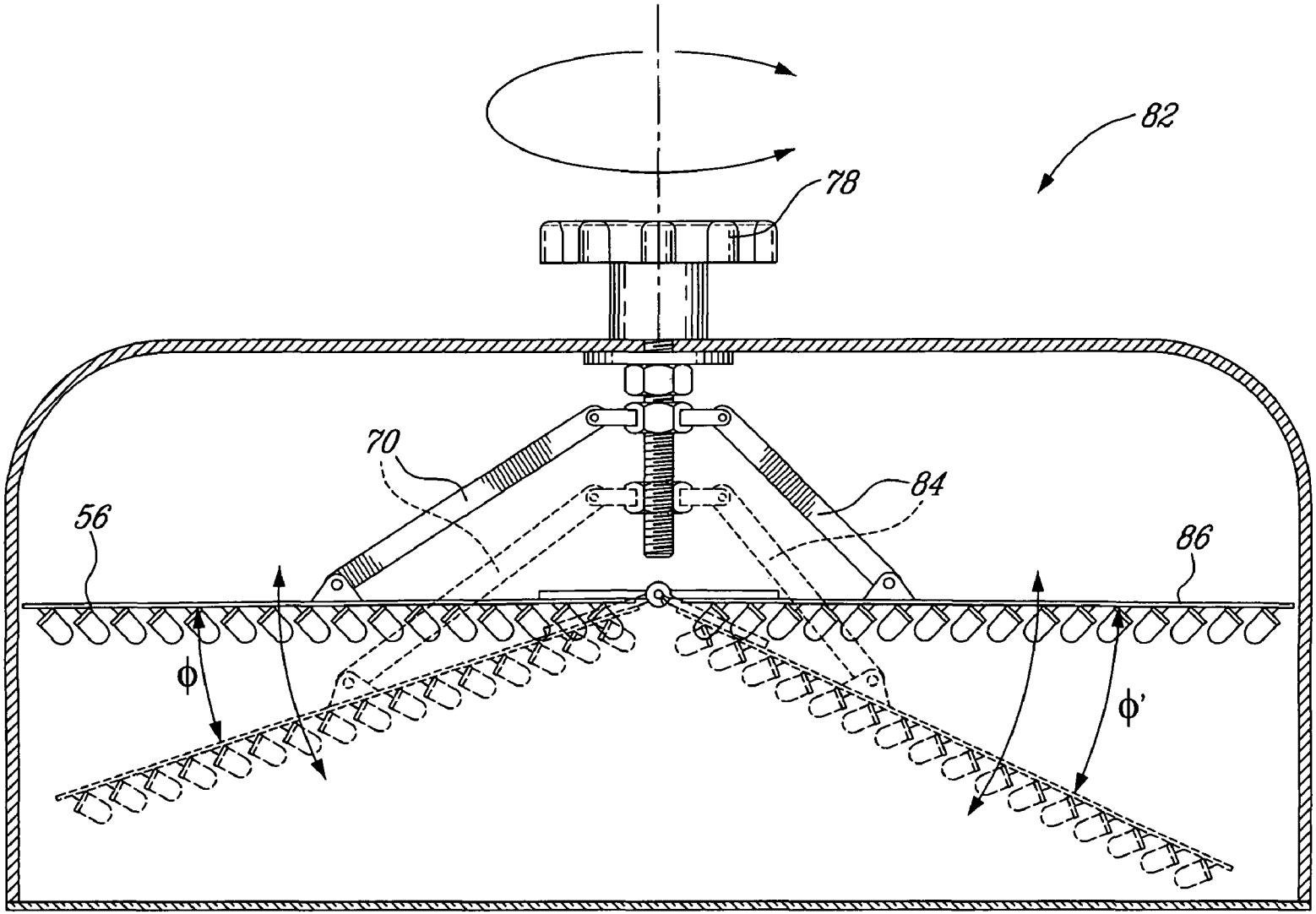
FIG. 10 is a cross section of an assembly of light emitting diodes for a streetlight according to a fourth illustrative embodiment of the present invention.

For example, as illustrated in FIG. 10, the length of lever arms 84 securing one of the boards 86 can be different than the other lever arms 70, thereby allowing to modify the angle Φ' between the board 86 and the horizontal at a different pace than the other angle Φ upon rotation of the knob 78.

Figure 11:
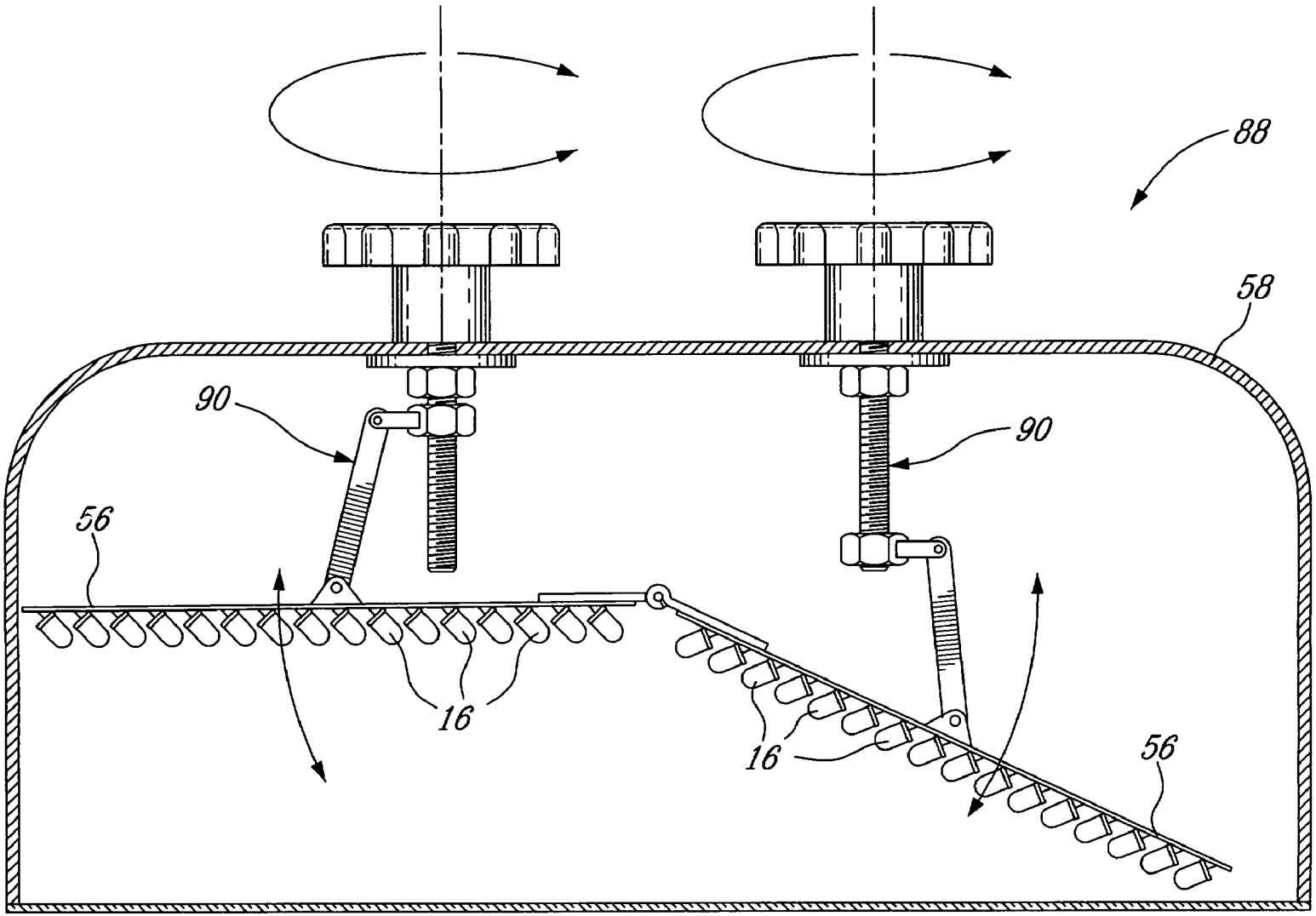
FIG. 11 is a cross section of an assembly of light emitting diodes for a streetlight according to a fifth illustrative embodiment of the present invention.

An assembly 88 of LEDs 16 for a streetlight according to a fifth embodiment of the present invention will now be described with reference to FIG. 11.

Since the assembly 88 is very similar to the assembly 54, and for concision purposes, only the differences between the two assemblies will be described herein in more detail.

According to this fifth illustrative embodiment, each of the boards of LEDs 56 is secured to the casing 58 via an independent board mounting and adjustable mechanism 90 allowing to independently adjust the angle between the board 56 and the horizontal for example.

Even though the mechanisms 90 to adjust the angle of the boards of LEDs according to the above illustrated embodiments are all manually activated, a motor (not shown) can also be provided to tilt the boards of LEDs 56. This motor can be activated using a button or another user's input means provided on the assembly of LEDs 88 or provided on a remote control. Of course, in that case, a wireless receiver (not shown) would be included with or connected to the LEDs controlling system.

Figure 12:
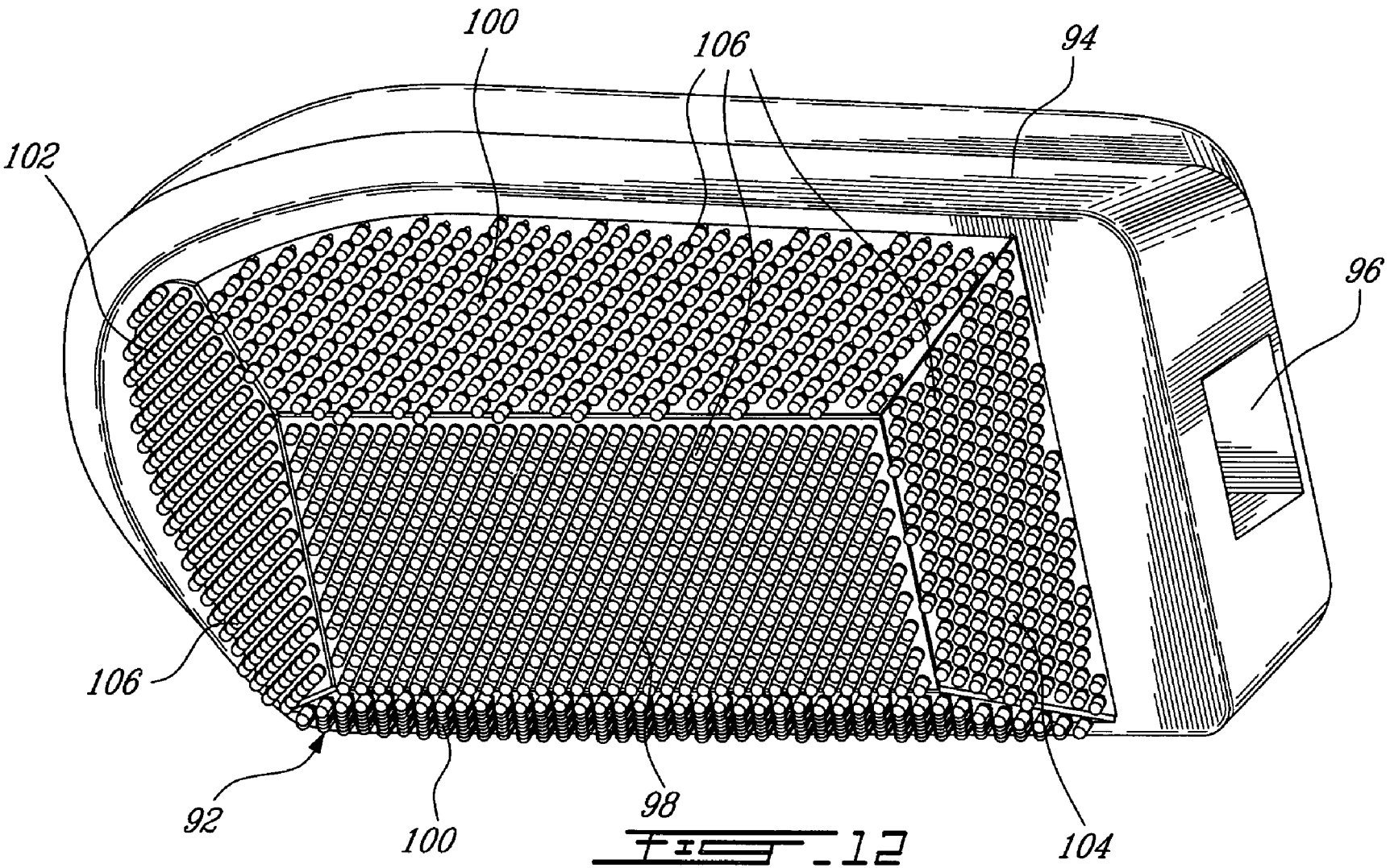
FIG. 12 is a perspective view of an assembly of light emitting diodes for a streetlight according to a sixth illustrative embodiment of the present invention.

An assembly 92 of light emitting diodes for a streetlight according to a sixth illustrative embodiment of the present invention will now be described with reference to FIG. 12.

The assembly 92 comprises a receptacle 94, including a side aperture 96 for mounting to the horizontal pole of a street pole (both not shown), a plurality of boards of LEDs 98-104 secured to the receptacle 94 and a system for controlling the LEDs (not shown) received in the receptacle 94.

More specifically, the assembly 92 comprises a central board of LEDs 98 to be positioned generally parallel to the area to illuminate and defining a first light projection plane. The assembly 92 further comprises two lateral boards of LEDs 100 mounted to the first board of LED so as to define an angle therewith and defining second and third light projection plane. Front and back boards of LEDs 102 and 104 are each secured to the two lateral boards 100 therebetween and to the central board 98 at opposite ends thereof. The boards of LEDs 98-104 together define a convex light projector. Each LED 106 is secured to its respective board so as to extend perpendicularly therefrom.

Figure 13:
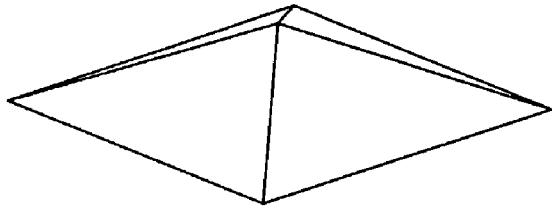
FIG. 13 is a perspective schematic view of an assembly of light emitting diodes for a streetlight according to a seventh illustrative embodiment of the present invention.
Figure 14:
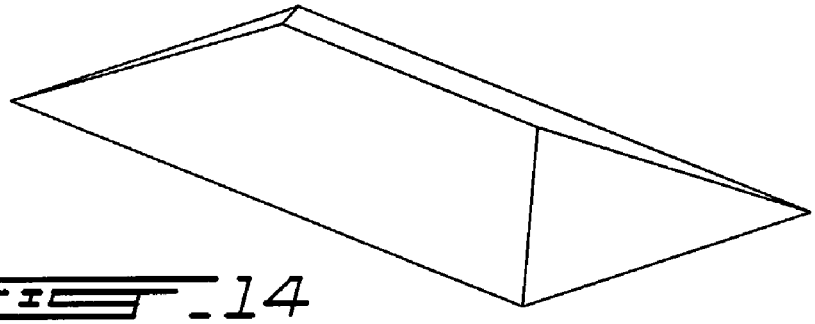
FIG. 14 is a perspective schematic view of an assembly of light emitting diodes for a streetlight according to an eighth illustrative embodiment of the present invention.

The number and configuration of the boards of LEDs may of course vary. FIGS. 13 and 14 illustrate two general configurations of assembly of LEDs for a streetlight according respectively to a seventh and an eight illustrative embodiment of the present invention.

According to a further embodiment of the present invention, there is provided a casing or a support frame (not shown) having a plurality of grooves, channels or any other means to adjustably receive boards of LEDs. According to this embodiment, different assemblies of LEDs can be achieved by inserting the boards in different grooves or channels. Different means can be provided to removably, secure the boards in place, including snap fitting, fasteners, etc.

Figure 15:
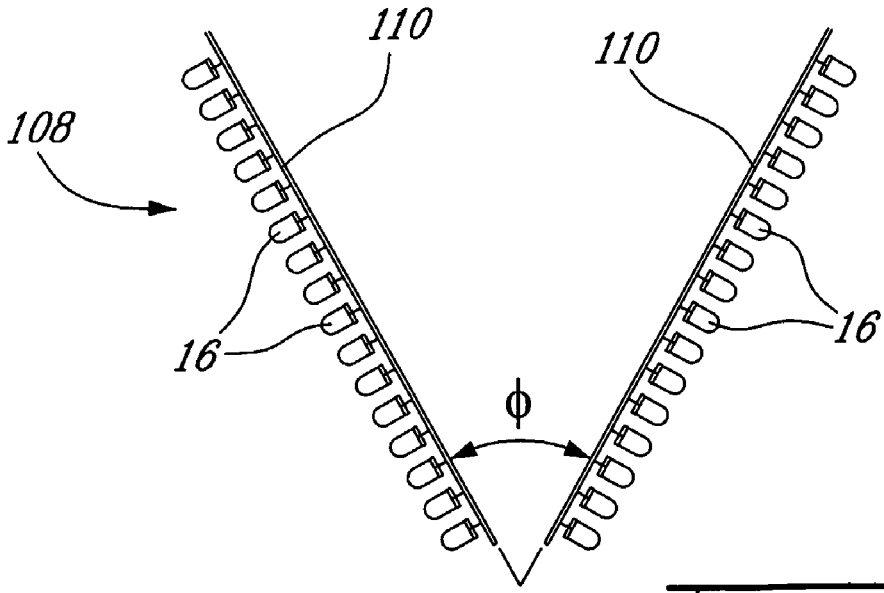
FIG. 15 is a side schematic view of an assembly of light emitting diodes for a streetlight according to a ninth illustrative embodiment of the present invention.
Figure 18:
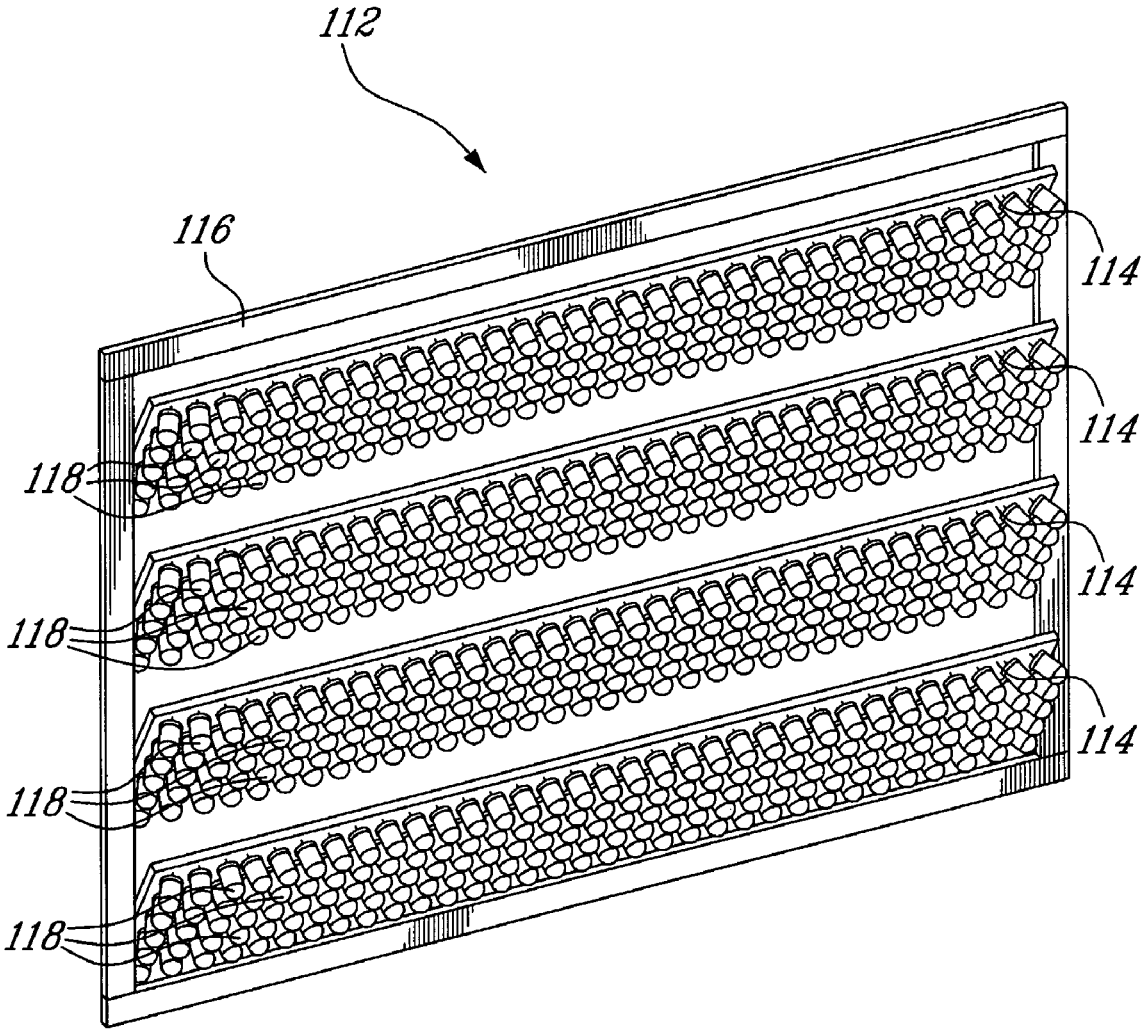

FIG. 15 illustrates an assembly 108 of LEDs for a streetlight according to an eight illustrative embodiment of the present invention.

The assembly 108 comprises two boards of LEDs 110 mounted adjacent one another so as to define an acute angle therebetween. It is to be noted that the assembly 108 is only schematically illustrated in FIG. 15. It further includes a frame or a casing (not illustrating) for receiving and supporting the boards 110 and a system for controlling the LEDs (not shown) to be connected to the utility line.

The assembly 108 may further include a mechanism (not shown) for modifying the angle Φ between the two boards 110. It is to be noted that, contrarily to the assembly 14 where the LEDs 16 are mounted on facing sides of the boards 18 for adjacent panels 20, the LEDs 16 are mounted on opposite sides of the boards 110.

The angle Φ between the two boards 110 is only limted by the dimensions of the boards 110 with the LEDs 16 and thus can have typically any values from near zero (0) degrees to more than 340 degrees. The same can be said when the LEDs are mounted on facing sides of the boards as illustrated, for example, in FIG. 4.

Turning now to FIG. 16, an assembly 112 of light emitting diodes for a lighting application according to a tenth illustrative embodiment of the present invention will now be described.

The assembly 112 comprises a plurality of slats 114 (four illustrated) pivotably mounted to a frame 116 so as to define a louver. Each slat 114 includes a matrix of LEDs 118. Each of the LEDs is of course to be connected to a power source (not shown) via controlling system (not shown).

A mechanism (not shown) is provided to adjust the angle of the slats 114. Since such mechanism allowing to simultaneously or independently adjusting the angles of the slats 114 are believed to be well-known in the art, and for concision purposes, they will not be described herein in more detail.

The three (3) rows of LEDs near the longitudinal edges of the slats 114 are mounted to the slats 114 so as to define an angle therewith. More specifically, the angle is inversely proportional with the distance from the nearest side edge of the frame 116. This configuration of LEDs allows providing a more distribute illumination by orienting some of the light on the lateral sides of the assembly 112.

Of course, the number slats 116 and the number of LEDs 118 on each slat 116 may vary. The slats 116 may also be mounted to any structure so as to yield the louvers functionality.

Also, any configuration of LED angle on each slat is possible and is not limited to the one illustrated.

Experimental results have been compared between a two-board assembly of LEDs according to an eleventh illustrative embodiment of the present invention and Type II and II Cobra lights from the Cooper Lighting society. The results have been obtained considering the assembly according to the present invention and the Cobra lights mounted on top of a 25 feet pole.

| Type of LED | Typical Intensity |
|---|---|
| (20 deg) Brite Led BL-LBUW5N20C | 12600 mcd |
| (45 deg) C9045ULWW (45) | 5311 mcd |

| BOARD #1 | | | |
|---|---|---|---|
| | Aim X | Aim Y | Qty of LEDS |
| Brite Led BL-LBUW5N20C | −60 | 10 | 130 |
| Brite Led BL-LBUW5N20C | −60 | 30 | 150 |
| C9045ULWW (45) | −22 | 26 | 120 |
| C9045ULWW (45) | −10 | −8 | 60 |
| Brite Led BL-LBUW5N20C | 0 | 30 | 30 |
| Brite Led BL-LBUW5N20C | 0 | 10 | 10 |

| BOARD #2 | | | |
|---|---|---|---|
| | Aims X | Aim Y | Qty of LEDS |
| Brite Led BL-LBUW5N20C | 60 | 10 | 130 |
| Brite Led BL-LBUW5N20C | 60 | 30 | 150 |
| C9045ULWW (45) | 22 | 26 | 120 |
| C9045ULWW (45) | 10 | −8 | 60 |
| Brite Led BL-LBUW5N20C | 0 | 30 | 30 |
| Brite Led BL-LBUW5N20C | 0 | 10 | 10 |

where "Aim X" represents the point on the ground where the LEDs are aimed at (parallel to the street); and "Aim Y" represents the point on the ground where the LEDs are aimed at (perpendicular to the street).

The light distribution obtained with the above LED assembly as been compared with two 100 W HPS 9200 Lumen clear lens light from Cooper Lighting. The first one is a type II medium cut-off, model HPRC-GL-2-100-T-LL and the second one is a type III medium cut-off, model HPRC-GL-#-100-T-LL.

Figure 17:
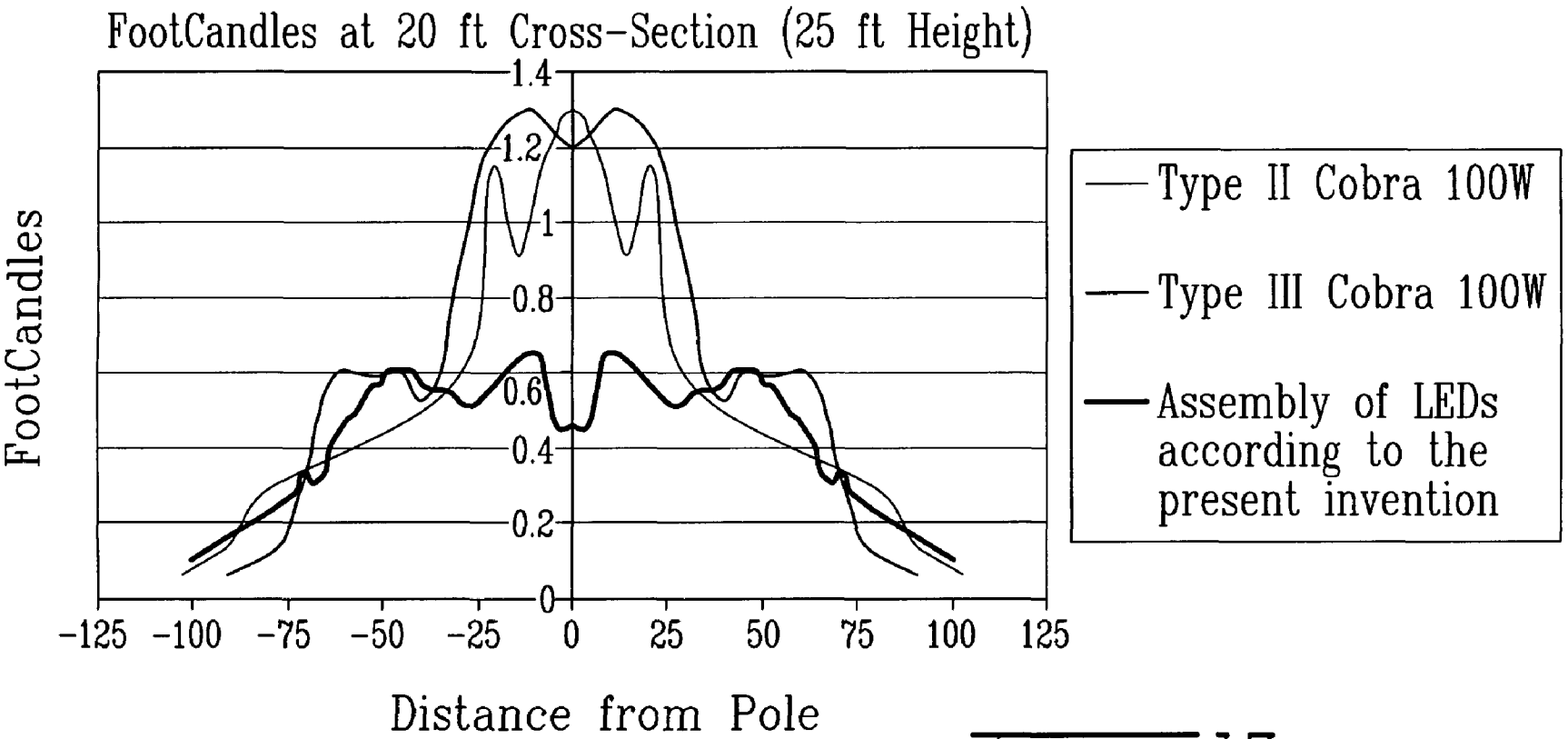
FIG. 17 is a graph showing comparison results between lights according to the prior art and a light provided with an assembly of LEDs according to an eleventh illustrative embodiment of the present invention.

The comparison results are illustrated in FIG. 17, which clearly show that a more distribute illumination is obtained with the assembly of LEDs according to the present invention.

As enlighten by the last example, an assembly of LEDs for a light according to the present invention can be provided with different types of LEDs, even on a same board. For example, some LEDs may have a 20 degrees light pattern, wherein an intensity of 50 percent is obtained at 10 degrees from the longitudinal axis, while other LEDs may have 30, 40, 45 or 60 degrees pattern with different maximum intensity for example. Since such LED pattern is believed to be well known in the art, and for concision purposes, they will not be described herein in more detail. Also, LEDs having different colors can also be provided in the assembly or in a single board.

Even though the present invention has been described by way of reference to illustrative embodiments where all LEDs on a board are bent or tilted so as to define a common angle, an assembly according to the present invention is not limited in such a way. Indeed, a single board may include different LEDs tilted so as to define different angles to simultaneously illuminate in different directions.

Also, even though the present invention has been described by way of references to boards of LEDs having a plurality of columns and lines of LEDs, an assembly of LEDs according to the present invention including boards of LEDS having a single line of LEDs mounted thereon can also be provided.

According to the present invention, boards of LEDs wherein the tilt of each line or column of LEDs can independently be adjusted can also be provided.

Even though the present invention has been described with reference to assembly of LEDs for a streetlight, an assembly of LEDs according to the present invention can be used in any type of lights and for any lighting applications.

Although the present invention has been described hereinabove by way of preferred embodiments thereof, it can be modified without departing from the spirit and nature of the subject invention, as defined in the appended claims.

What is claimed is:

1. An assembly of light emitting diodes for a streetlight, comprising:

a first board, defining a first plane, having a first matrix of light emitting diodes (LEDs) mounted thereon, wherein the individual LEDs from said first matrix of LEDs are tilted toward said first board at a first angle; and a second board, defining a second plane, having a second matrix of LEDs mounted thereon, wherein the individual LEDs from said second matrix of LEDs are tilted toward said second board at a second angle, said second board being mounted to said first board at an intersection so as to define a third angle, wherein the LEDs of the first matrix and the LEDs of the second matrix are tilted toward the intersection of the first board and the second board, wherein said second board is hingedly mounted to said first board so as to allow selectively modifying said third angle.

2. An assembly as recited in claim 1, wherein a first group of LEDs from said first matrix of LEDs defines a fourth angle with the intersection and a second group of LEDs from said second matrix of LEDs defines a fifth angle with the intersection.

3. An assembly as recited in claim 1, wherein each of said first and second boards are mounted in respective first and second panels.

4. An assembly as recited in claim 1, wherein said LEDs include at least two different types of LEDs.

5. An assembly as recited in claim 4, wherein said at least two different types of LEDs are characterized by at least one of a colour, an angle of light pattern, and intensity.

6. An assembly as recited in claim 4, wherein said at least two different types of LEDs are provided on a same one of first and second boards.

7. An assembly as recited in claim 1, wherein said first and second boards are each secured to an independent board mounting and angle adjustable mechanism which allows to independently adjust a respective angle between each of said first and second boards and a third plane of reference.

* * * * *